US006254732B1

(12) United States Patent
Savolainen

(10) Patent No.: US 6,254,732 B1
(45) Date of Patent: Jul. 3, 2001

(54) METHOD FOR LOADING A SEAL OF A SUCTION ROLL AND A SEALING CONSTRUCTION THEREOF

(75) Inventor: Hannu Savolainen, Petäjävesi (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 09/297,793

(22) PCT Filed: Oct. 7, 1998

(86) PCT No.: PCT/FI98/00782

§ 371 Date: May 6, 1999

§ 102(e) Date: May 6, 1999

(87) PCT Pub. No.: WO99/18286

PCT Pub. Date: Apr. 15, 1999

(30) Foreign Application Priority Data

Oct. 7, 1997 (FI) ..... 970435 U

(51) Int. Cl.[7] ..... D21F 3/10

(52) U.S. Cl. ..... 162/371; 162/370; 162/369; 162/368; 162/363; 162/205; 162/204; 277/300; 277/345; 277/583; 277/910; 277/913

(58) Field of Search ..... 162/371, 370, 162/369, 368, 363, 205, 204; 277/300, 345, 583, 910, 913

(56) References Cited

U.S. PATENT DOCUMENTS 4,915,787 4/1990 Branyon .
5,580,424 12/1996 Snellman .

*Primary Examiner*—Stanley S. Silverman
*Assistant Examiner*—Mark Halpern
(74) *Attorney, Agent, or Firm*—Fildes & Outland, P.C.

(57) ABSTRACT

A sealing construction for loading a seal against a suction roll in a paper machine includes a seal having a wear surface, side surfaces and a lower surface. The seal is fitted from its holder to the structure of a suction box which is inside the suction roll. The seal essentially covers the whole operating length of the suction roll, extending from its wear surface to the inner face of the mantle of the suction roll. The seal is moveable in the direction of the radius of the suction roll in the holder by a pressure effect that is applied directly onto the lower surface of the seal. Negative pressure or vacuum can be applied during operation to draw the seal into its holder to reduce seal wear.

8 Claims, 4 Drawing Sheets

METHOD FOR LOADING A SEAL OF A SUCTION ROLL AND A SEALING CONSTRUCTION THEREOF

FIELD OF THE INVENTION

The present invention relates to a method for sealing a vacuum space in a suction roll in a paper machine and a seal therefor. The seal includes a wear surface, side surfaces and a lower surface and is fitted from its holder to a suction box inside the suction roll. The seal essentially covers the whole operating length of the suction roll, extending by its wear surface to the inner face of the mantle of the suction roll. The seal is urged in the direction of the radius of the suction roll in the holder with a loading device that loads the seal.

BACKGROUND OF THE INVENTION

It is known in the art that suction rolls are used in paper machines on the one hand to gather water from a paper web, on the other hand to direct the paper web in the roller groups. By setting a vacuum inside the mantle of the perforated suction roll, the paper web can be maintained on the surface of the suction roll. The necessary vacuum is produced by vacuum chambers, which are confined between the mantle and the suction box with sealing devices that cover the whole of the operating length of the suction roll.

These sealing devices each have a seal that extends to the inner face of the mantle, and there are two or more of them inside one suction roll. The seal is quickly used up when constantly pressed against the inner face of the mantle. Several pressing and regulation devices have been developed primarily for the purpose of reducing seal wear. For example, a sealing construction presented in FI patent application number 955275 includes loading hoses. Therein, the seal is pressed onto the mantle with one loading hose, and it is slightly pressed back with the other hose locking the seal into place. The principle is thus to lock the seal a small distance away from the mantle after the starting of the suction roll, whereby seal wear is reduced.

Due to the bend of the suction box, the elastic limit of the seal comes quickly to an end. One of the problems of the present seals is that they provide for only a small elastic movement length. It has not been possible to reduce the scale of the suction box and therefore the whole suction roll. It has only been possible to allow the suction box a slight bend.

In order to reduce the wearing of seals, the above-mentioned known solution has been carried out in a very complex way. Loading devices that include several components add to the risk of malfunctions. In addition, loading devices need to be manufactured accurately in order to function, which adds to the manufacturing and servicing expenses and further to the risk of malfunctions. The operating distance of loading devices is also limited, whereby they are only suited to seals of a certain height.

SUMMARY OF THE INVENTION

An object of the present invention is to produce a simple suction roll sealing construction that is suitable for different seal heights, the mantle load of which can be regulated and with which it is possible to achieve an essentially wider elastic limit than present constructions.

A sealing construction for loading a seal against a suction roll in a paper machine includes a seal having a wear surface, side surfaces and a lower surface. The seal is fitted from its holder to the structure of a suction box which is inside the suction roll. The seal essentially covers the whole operating length of the suction roll, extending from its wear surface to the inner face of the mantle of the suction roll. The seal is moveable in the direction of the radius of the suction roll in the holder by a pressure effect that is applied directly onto the lower surface of the seal. Negative pressure or vacuum can be applied during operation to draw the seal into its holder to reduce seal wear.

According to the present invention the seal itself operates as part of the loading device, whereby the sealing structure is simplified. Loading hoses and other prior art devices thus can be eliminated when the pressure effect of the pressure medium is applied directly onto the lower surface of the seal. In addition to pressing the seal against the mantle, it can be moved in the way desired in its holder. At the same time, however, the characteristics of the seal stay the same regardless of its wear. Existing seal holders can be used in the installation of a sealing construction according to the invention, and the life of the seal can be lengthened simply by adding to its height.

These and other features and advantages of the invention will be more fully understood from the following detailed description of the invention taken together with the accompanying drawings.

DETAILED DESCRIPTION OF THE INVENTION

Figure 1:
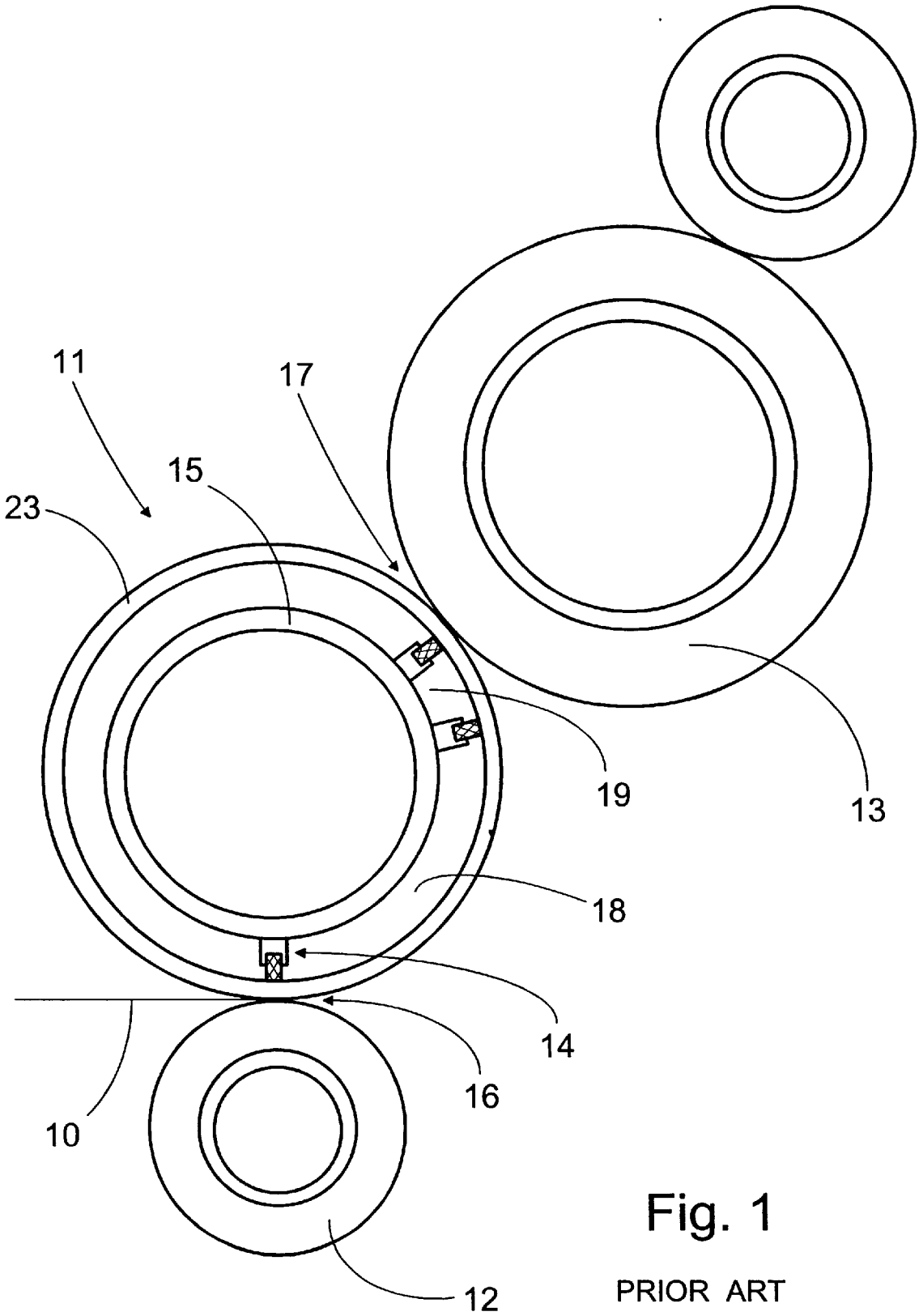
Fig. 1 PRIOR ART
FIG. 1 illustrates a suction roll in a paper machine operative to remove water from the web and having a sealing construction according to the invention installed inside a suction roll.

Referring now to the drawings in detail, FIG. 1 illustrates one roller group in a paper machine. In the process, a paper web 10 is directed from in between a suction roll 11 and its first counter roll 12 onto the suction roll 11. The paper web 10 is directed farther from the suction roll 11 through another counter roll 13. A sealing device 14, according to the invention, is attached to a suction box 15, which is situated inside the suction roll 11. In the illustrated example, there are three sealing devices 14 organized inside the suction roll 11 in the area between nips 16 and 17 formed by the suction roll 11 and the counter rolls 12 and 13. These sealing devices 14 form the necessary vacuum chambers 18 and 19. In addition to directing the paper web 10, the suction roll 11 is used to remove humidity from the paper web 10.

Figure 2:
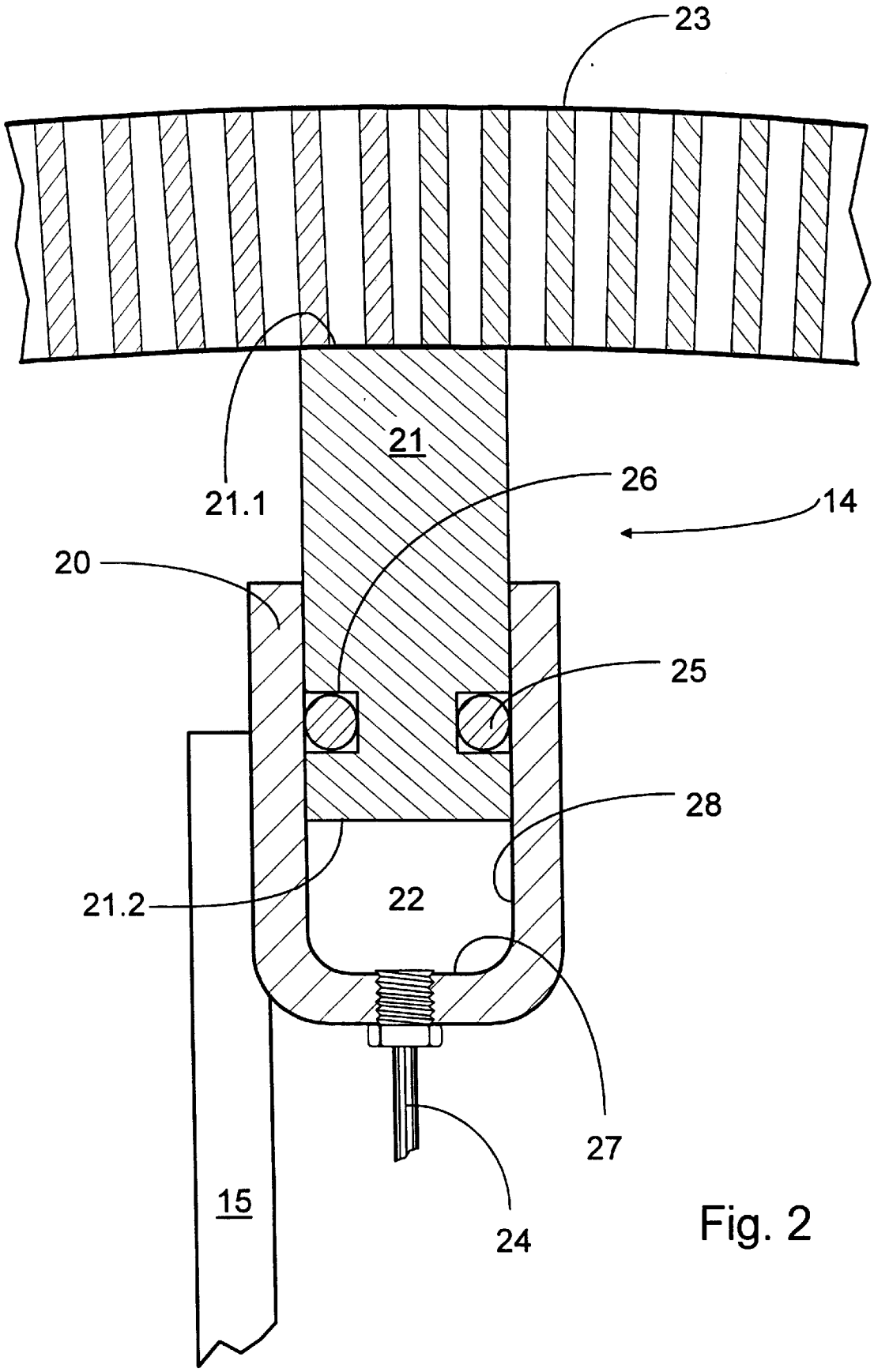
FIG. 2 is a cross-sectional view of the sealing construction according to the invention as seen from the compressed-air connection.

FIG. 2 illustrates a sealing device 14 according to the invention in its operational position wherein seal 21 is urged against mantle 23. The cross section of an ordinary holder 20 is of a U-shape. It is manufactured from cold-rolled steelplate, whereby its surfaces 27, 28 are naturally even. The glide surfaces 28 need little, if any, polishing. The holder 20 is attached to the structure of the suction box 15 from its other side. The holder 20 is essentially of the same length as the suction roll 11 and bends together with the suction box. The seal 21 has been fitted tightly although movably into the holder 20. The wear surface 21.1 of the seal 21 glides along the inner face of mantle 23.

According to the invention, the holder 20, the lower surface 21.2 of the seal 21 and the space 22 limited by them have been set to cooperate and to thereby define and/or form a loading device. Thus, no separate loading hoses or other spacers are needed in order to load the seal 21 against the mantle. Seal 21 is preferably formed out of graphite rubber and can be movably engaged and attached to the mantle 23 of the suction roll 11 simply by leading pressurized air through the connection 24 to the above-mentioned space 22.

In a preferred embodiment, seal 21 includes an O-ring band 25, which has been fitted to the grooves 26 on the lower surface of the seal 21 for ensuring sealing engagement of the seal 21 in the holder 20. An O-ring seal 25 is sealed onto the inner surfaces 28 of the holder 20 in the manner shown in FIG. 2. The space 22 between the holder 20 and the seal 21 has also been sealed at the end of the holder 20, which is discussed in more detail in relation to FIG. 3.

When the paper web 10 comes on top of the suction zone between nips 16 and 17, a vacuum rises in the vacuum chambers 18 and 19. In practice, the vacuum that operates in the suction holes sucks the seal 21 against the mantle 23 although the pressure is removed from underneath the seal 21. Hereby, the seal 21 rubs against the suction roll 11 with its wear surface 21.1 even though the pressure has been removed, and is used up at the same time. In order to reduce this wearing, a vacuum may be formed according to the invention in the space 22 limited by the seal 21 and the holder 20, by which vacuum the seal 21 is pulled from is lower surface 21.2 away from the suction roll 11.

In other words, a vacuum can be applied to neutralize the effect of the suction that is directed toward the wear surface 21.1. The vacuum is formed underneath the seal 21, on the lower surface 21.2. The necessary vacuum is lower than the pressure that operates inside the suction roll, because the area of operation at the upper end of the seal 21 is smaller due to the perforation of the suction roll 11. Normally, the share of holes on the surface of the suction roll 11 on its operational length is about 25%. Thereby, a fourth of the vacuum that operates in the vacuum chamber is needed while operating to neutralize the effect of suction. The effect of the auxiliary seal 25 on need of the vacuum is slight.

In order to direct a suitable pressure underneath the seal 21, the holder 20 contains at least one connection 24, which has been connected to the necessary valves and pressure regulators (not shown). Preferably, each sealing device 14 has its own valve, whereby it is possible to compensate for the different circumstances of the particular sealing device.

Figure 3:
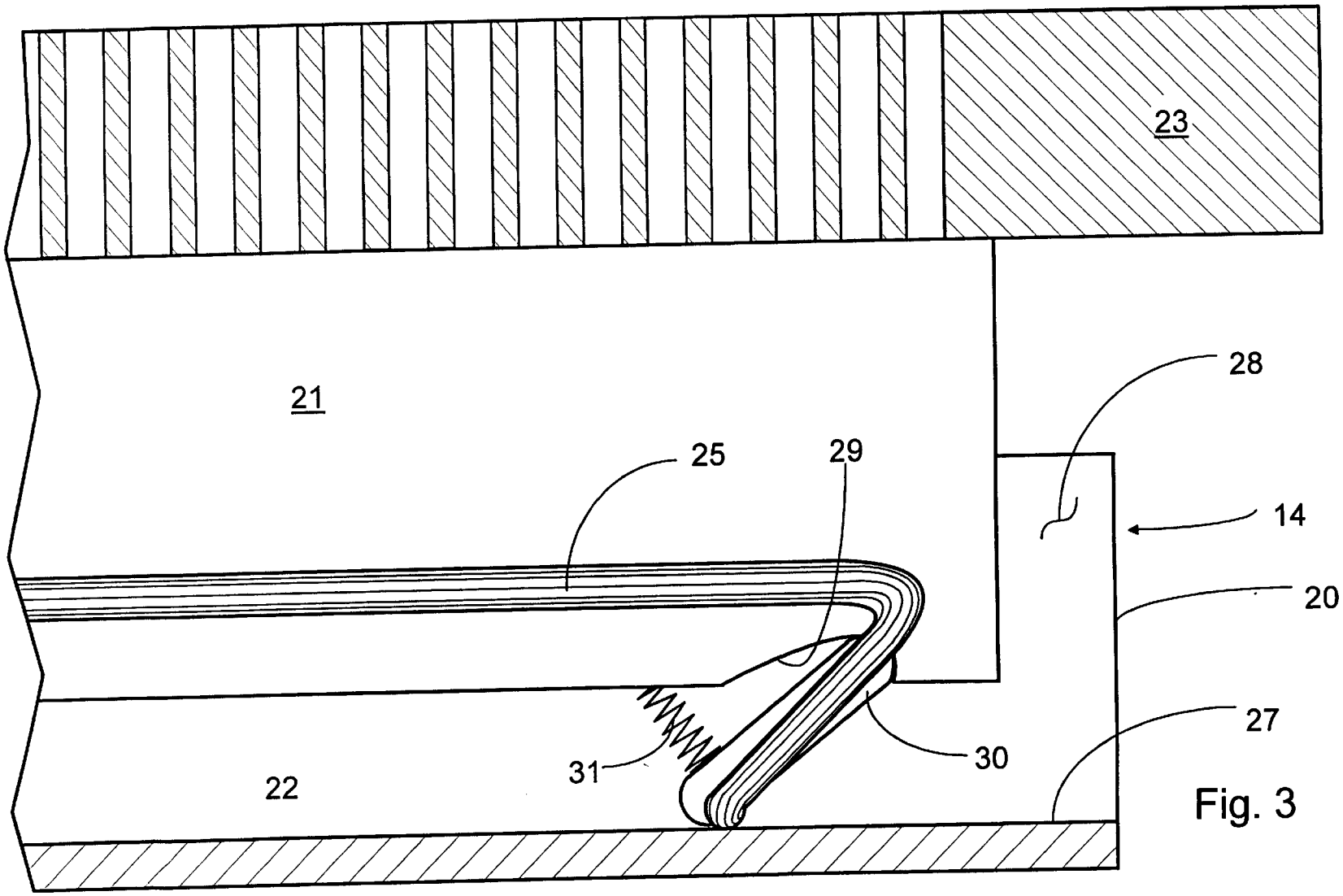
FIG. 3 is a cross-sectional view of the sealing construction according to the invention as seen from the end at the level of the surface of the seal.

FIG. 3 illustrates the holder 20 of the sealing device 14 according to the invention in cross section. In order to enable the expansion of the seal 21 during the operation, the holder 20 is, as is well known, open from its ends. Therefore, the ends of the seal 21 have to be sealed at the bottom 27 and on the sides 28 of the holder 20. One possible solution is presented in FIG. 3. Here, an end seal 30, that is essentially of the same width as the holder 20, is fitted to groove 29 at the end of the seal 21, which end seal directs the auxiliary seal 25 along the inner surfaces 27 and 28 of the holder 20 underneath the seal 21. Furthermore, the end seal 30 adapts to the movement of the seal 21. In order to ensure proper sealing, the end seal 30 is loaded by a spring 31. In this solution, the vertical and horizontal movement of the seal 21 does not affect the sealing of space 22.

Figure 4:
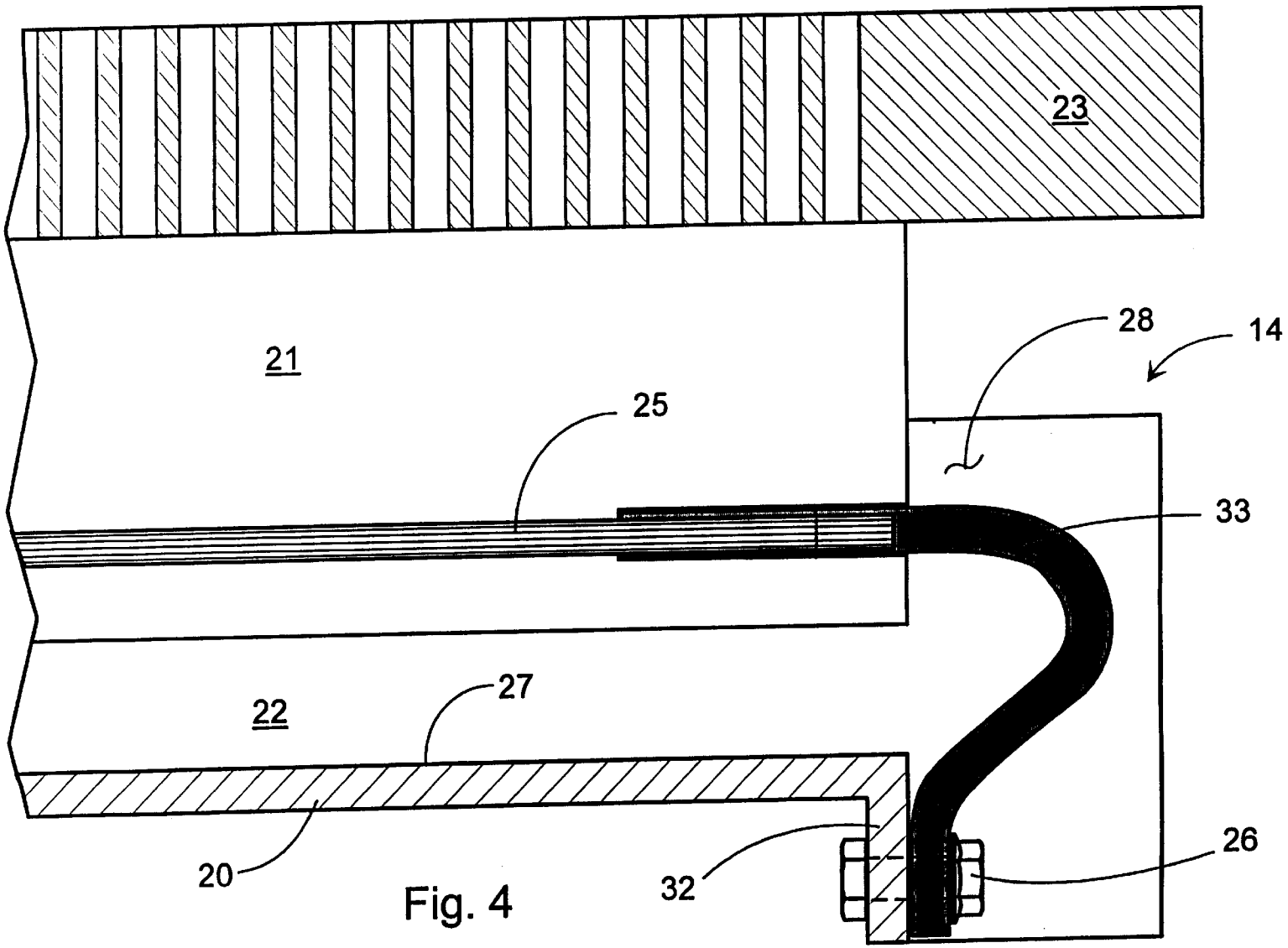
FIG. 4 is another cross-sectional view of the sealing construction as seen from the end as in FIG. 3.

FIG. 4 illustrates another type of end seal. Functionally, similar parts are represented by the same reference numbers as in FIG. 3. The bottom 27 of the holder 20 is cut open at the end of the holder, and the sides 28 are extended downwards. A flange 32 works as a continuation of the bottom 27. A rubber or elastic strip 33 is fitted onto the end of the seal 21, which strip overlaps a certain distance with the auxiliary seal 25 on the sides of the seal 21. In order for this to happen, the rubber strip 33 extends farther on the sides along the seal 21 than the middle part. When somewhat pressed, the rubber strip 33 is of the same width as the inner space of the holder 20 and it is attached from one end with a bolt 26 to the flange 32. Hereby, the rubber strip 33 fully closes the space 22 towards the end, still allowing for the movement and heat expansion of the seal 21.

The solution, according to the invention, is best suited to the second sealing construction in the direction of the entrance, and to latter sealing constructions, and in some circumstances also to the first sealing construction. It is possible to modify the structure to suit existing suction boxes without any significant alteration to the suction box. The lightening of the load on the seal engaged with the mantle essentially lengthens the life of the seal and further the servicing intervals. The service life can further be lengthened using seals that are taller than normal, because it is possible, e.g., by eliminating the loading hose to increase the wear height of the seal by about 5 mm. The sealing according to the invention can, in principle, be used as long as it stays in its holder, supposing that an adequate sealing effect remains.

Although the invention has been described by reference to a specific embodiment, it should be understood that numerous changes may be made within the spirit and scope of the inventive concepts described. Accordingly, it is intended that the invention not be limited to the described embodiment, but that it have the full scope defined by the language of the following claims.

What is claimed is:

1. A method for loading a seal of a suction roll, which includes a mantle, a suction box therein, a holder supported by the suction box and having a U-form with an inner surface, and wherein the seal includes a wear surface, side surfaces and a lower surface and which generally covers the whole operational length of the suction roll, extending by its wear surface onto an inner face of the mantle and wherein the seal has been fitted from its side surfaces into its holder, where the seal is moveable in the direction of the radius of the suction roll, the method characterized by providing a closed space, bounded by the lower surface of the seal and the inner surface of the holder, under the seal, and pressurizing the enclosed space with a positive/negative pressure, whereby the pressure acts directly onto the lower surface of the seal to move the seal in said holder.

2. A sealing device of a suction roll, which includes a mantle, a suction box therein, and a loading device characterized by a holder supported by the suction box and having a U-form with an inner surface, and a seal including a wear surface, side surfaces and a lower surface and generally covering the the whole operational length of the suction roll, said wear surface extending onto the inner face of said mantle, said side surfaces being fitted into said holder and forming a closed space bounded by the lower surface of the seal and the inner surface of the holder, said seal being moveable relative to the holder along a radius of the suction roll by the application of positive/negative pressure directly onto the lower surface of said seal.

3. A sealing device according to claim 2, characterized in that at least one connection that extends to the said space has been fitted in the holder in order to form the pressure effect in the said space.

4. A sealing device according to claim 3, characterized by another seal, which extends in grooves around the seal fittable from its holder, an inner face of the holder functioning as the seal surface of said another seal.

5. A sealing device as in claim 4 wherein the another seal is an O-ring.

6. A sealing device according to claim 4, characterized in that the grooves at the end of the seal extend toward the lower surface of the seal in order to make possible the passing of the said another seal, underneath the seal.

7. A sealing device according to claim 6, characterized by an end seal that moves according to the location of the seal is arranged between the holder and the seal in the end parts of the seal in order to direct the said another seal along the inner face of the holder from one side of the seal to the other.

8. A sealing device according to claim 4, characterized by an elastic strip at the end of the seal, defining a continuation of it that is essentially of the same width as the inner space of the holder, which strip is attached from one end to the holder so that it closes the said space from the end.

* * * * *